United States Patent [19]

Förster et al.

[11] Patent Number: 4,943,213

[45] Date of Patent: Jul. 24, 1990

[54] INTERNAL AXIS ROTARY PISTON MACHINE WITH MESHING ENGAGEMENT BETWEEN OUTER AND INNER ROTORS

[75] Inventors: Arno Förster, Worms; Gerhard Oberholz, Freinsheim; Christiane Römuss, Beindersheim, all of Fed. Rep. of Germany

[73] Assignee: Aktiengesellschaft Kuehnle, Kopp & Kausch, Frankenthal, Fed. Rep. of Germany

[21] Appl. No.: 194,545

[22] Filed: May 16, 1988

[30] Foreign Application Priority Data

May 14, 1987 [DE] Fed. Rep. of Germany ..... 3716083

[51] Int. Cl.[5] ..... F04B 21/02

[52] U.S. Cl. ..... 417/310; 418/168; 418/141

[58] Field of Search ..... 418/166, 168, 39, 141; 417/299, 305, 308, 310, 558, 440; 137/599.2, 110; 123/564

[56] References Cited

U.S. PATENT DOCUMENTS

| | | | |
|---|---|---|---|
| 1,955,799 | 4/1934 | Fielden | 417/310 X |
| 2,177,976 | 10/1939 | Braver | 418/39 |
| 3,139,835 | 7/1964 | Wilkinson | 418/168 X |
| 4,017,221 | 4/1977 | Dezelan | 417/305 |
| 4,466,414 | 8/1984 | Yoshimura et al. | 123/564 |
| 4,470,767 | 9/1984 | Frings et al. | 417/310 |
| 4,502,283 | 3/1985 | Wandel | 417/310 X |
| 4,540,347 | 9/1985 | Child | 417/310 |
| 4,657,495 | 4/1987 | Sakamaki et al. | 418/95 X |
| 4,714,417 | 12/1987 | Wankel | 418/159 |
| 4,722,672 | 2/1988 | Rinneer | 417/310 |
| 4,740,140 | 4/1988 | Benson | 417/310 X |
| 4,750,867 | 6/1988 | Hertell et al. | 417/295 |

FOREIGN PATENT DOCUMENTS

| | | | |
|---|---|---|---|
| 547826 | 4/1932 | Fed. Rep. of Germany . | |
| 0223290 | 10/1986 | Japan | 418/141 |
| WO87/01760 | 3/1987 | PCT Int'l Appl. . | |

*Primary Examiner*—Leonard E. Smith
*Assistant Examiner*—Eugene L. Szczecina, Jr.
*Attorney, Agent, or Firm*—Foley & Lardner, Schwartz, Jeffery, Schwaab, Mack, Blumenthal & Evans

[57] ABSTRACT

An internal axis rotary piston machine containing in a housing (2), an outer rotor (26), with which an inner rotor (8) having n engagement parts (9) is in meshing engagement, there being n+1 recesses between engagement parts (34) of the outer rotor (26). The inner rotor (8) and outer rotor (26) rotate uniformly at a speed ratio of (n+1):n. There is contact of the tooth-flank type between inside faces of the outer rotor (26) and outside faces of the inner rotor (8) such that working spaces (66) are formed and move past inlet and outlet orifices (63, 64) of the housing (2). The rotary piston machine is designed in such a way that cost-effective production can be achieved while assuring a simple construction. To achieve this, it is proposed that the housing (2) should have, on the drive side, a bottom (4) formed in one piece and should be made pot-shaped. The bottom (4) has an outer face for a bearing (30) of the outer rotor (26), especially on a ring (28) extending axially into the end of the outer rotor (6).

10 Claims, 3 Drawing Sheets

INTERNAL AXIS ROTARY PISTON MACHINE WITH MESHING ENGAGEMENT BETWEEN OUTER AND INNER ROTORS

BACKGROUND OF THE INVENTION

The invention relates to an internal axis rotary piston machine with meshing engagement between an outer rotor surrounded by a housing and having n +1 recesses arranged between engagement parts and an inner rotor with n engagement parts. When there is contact of the tooth-flank type between inside faces of the outer rotor and outside faces of the inner rotor, the two rotors rotate uniformly at a speed ratio of (n+1) : n, and working spaces are formed in the recesses of the outer rotor and move past inlet and outlet orifices of the housing.

An internal axis rotary piston machine of this type is known from U.S. Pat. No. 4,714,417 and is used especially as a compressor for supercharging motor vehicle engines. The housing consists of an essentially cylindrical part which has an intake channel and an exhaust channel and which is closed off at each of its axial ends by means of a housing cover. The inner rotor and the outer rotor are rotatable about mutually offset parallel axes, the speed ratio corresponding to the ratio of the number of recesses of the outer rotor to the number of engagement parts extending outwards from the axis of the inner rotor. For this purpose, there is a gear which, on the one hand, has a pinion fastened on the shaft of the inner rotor and meshing with an internally toothed wheel associated with the outer rotor. Such a gear connection is recommended in order to obtain the best possible sealing of the gap between the two rotors and prevent wear, although in principle the tooth-flank type of contact between the mutually associated faces of the two rotors can make the additional gear-wheel connection superfluous. The shaft of the inner rotor and also the outer rotor are mounted in the covers of the housing by means of suitable bearings, such as roller bearings. The outer rotor has inside faces forming radially inner corner regions which are the curve generatrices for outer peripheral faces of the inner rotor. The inner rotor also has corner regions which represent the curve generatrices of the inside faces of the outer rotor.

SUMMARY OF THE INVENTION

The object of the invention is to improve the internal axis rotary piston machine of the aforementioned type such that cost-effective production can be achieved while assuring a simple construction.

Another object is to provide a rotary piston machine having a high functional reliability and a long service life while allowing for permissible production tolerances, particularly in large-quantity series production.

A further object of the invention is to provide an internal axis rotary piston machine with a reduced number of components, particularly those which must be fitted to each other within tolerances.

It is also an object of the invention to provide an internal axis rotary piston machine in which the fundamental kinematic principle of such a machine is realized with only a small weight and space requirement.

These and other objects of the invention are achieved by providing an internal axis rotary piston machine with meshing engagement between an outer rotor surrounded by a housing and having n+1 recesses arranged between engagement parts and an inner rotor with n engagement parts which rotate uniformly at a speed ratio of (n+1):n when there is tooth-flank type contact between inside faces of the outer rotor and outside faces of the inner rotor so that working spaces are formed in the recesses of the outer rotor and move past inlet and outlet orifices of the housing, wherein the housing (2) is constructed with a pot-shaped form having an integral bottom (4) on the drive side, and wherein said bottom (4) comprises an outer face for a bearing (30) of the outer rotor (26), particularly on a ring (28) extending axially into the end of the outer rotor (26).

In accordance with the invention, a rotary piston machine is provided comprising a housing which has, on the drive side, an integral bottom and is made pot-shaped, and the bottom is provided with an outer face for a bearing of the outer roller, particularly on a ring extending axially into the end of the outer rotor. In other words, the housing of the machine is in the form of a tubular body with one integrally closed end, and the machine is driven by a shaft, preferably of the inner rotor of the machine, which projects through an opening in the closed end of the housing. The closed end of the housing is also provided with an axially projecting annular portion defining a radially outward annular surface for supporting a bearing for the outer rotor of the machine.

The proposed rotary piston machine is characterized by an advantageous construction and can be reliably produced in large-quantity series. The design of the housing as a pot-shaped housing, i.e. as a tubular housing with one closed end, and the direct mounting of the outer rotor in the bottom of the pot-shaped housing assure an exact relative arrangement of the bearing point of the outer rotor in relation to the inner surface of the housing. Surfaces which require machining in a multi-part design, and the production tolerances which result from such machining, can be omitted. The required production outlay in terms of labor and assembly is appreciably reduced, and high accuracy can be reliably assured even in large-quantity production. The bottom of the housing has an integrally formed ring which extends axially inwardly to the inner rotor and on the outer face of which the bearing for the outer rotor is arranged. Because of the integral construction, a definite relative arrangement of the rotor mounting and consequently of the outer rotor in relation to the inner face of the housing is assured. Few individual parts are required altogether, especially as, to that extent, there is also no need for screws or other connecting elements.

Advantageously, the bearing for the shaft of the inner rotor is also incorporated in the bottom of the housing, thus likewise assuring an exact geometrical relative arrangement of the inner rotor both in relation to the outer rotor and in relation to the housing. In accordance with the invention, the aforementioned bearing of the inner rotor is axially spaced from the bearing of the outer rotor, so that the latter can be designed with a comparatively small diameter, with the result that a reduction in the circumferential speed in the bearing can be obtained in a simple manner.

In one particular embodiment, the bearing of the inner rotor is arranged in an extension formed integrally with the housing and furthermore, the inner rotor bearing and the extension in which it is mounted are arranged together within a belt pulley, or the like, which is fixedly connected to the shaft so as to rotate therewith. When a torque is exerted on the shaft through the pulley, for example by means of a pull of the belt, a bending moment on the shaft and the bearing is substantially completely avoided because the bearing of the inner rotor lies in essentially the same radial plane as the application of torque.

According to one particular embodiment, between a gear space, in which the gear intended for the drive connection between inner rotor and outer rotor is arranged, and the suction connection there is a line for the purpose of pressure equalization. This line can be arranged externally outside the housing or, in particular, can be incorporated in the housing as a longitudinal bore. As a result of this connecting line, a pressure build-up in the gear space is prevented, so that the lubricant required in the gear space for lubricating the tooth flanks cannot be forced into the working spaces. The advantages resulting from this in terms of service life and functional reliability are apparent.

In rotary piston machines of the aforementioned type, sealing of the end faces of the working spaces may be effected by means of piston rings. Depending on the instantaneous rotary position of the two rotors, the instantaneous pressure in the individual working spaces is different, so that the piston rings are subjected to uneven loading around their circumference and lose some of their sealing effect. To avoid such difficulties, in a special embodiment an annular groove is provided between the working spaces and the piston ring. Appropriately, such an annular groove is associated with each of the piston rings provided adjacent the axial ends of the outer rotor. These annular grooves are spaced axially from the working spaces, so that on the one hand pressure equalization is facilitated and on the other hand, an unacceptably high leakage flow is avoided because of the small annular gap between outer rotor and inner face of the housing in accordance with the invention.

According to one particular embodiment, a closing cover which closes off the gear space and closes an orifice in the housing cover is connected to the housing cover. The gear is arranged in the housing cover which closes off the pot-shaped housing according to the invention. The gear is easily accessible for maintenance by removing the closing cover, without having to disassemble or remove the rotors. Furthermore, the gear pinion, which advantageously is frictionally connected to the shaft of the inner rotor, remains accessible when the rotors are in the assembled state. The housing cover or even the rotor bearings need not be removed in order to vary the rotary position of the pinion relative to the inner rotor for the exact adjustment of the tooth-flank clearance. After removal of the closing cover and release of the connection of the pinion with the shaft, the pinion can be rotated somewhat on the shaft without further ado in order to attain the necessary adjustment of its rotational position. If necessary, the shaft can also be guided out through the closing cover, in order, for example, to couple an alternator or other assembly to the shaft of the inner rotor. To assure functionally reliable lubrication, a splash plate is arranged on the inner rotor and/or on the outer rotor in the gear space. By means of such splash plates, the lubricant is conveyed to the toothed rim of the outer rotor or to the pinion.

Finally, in one particular embodiment of the invention, arranged between the pressure connection and the suction connection there is an air circulation valve which, in specific operating states, facilitates control by recycling air from the pressure connection to the suction connection. This valve can serve for boost pressure control and also can advantageously be provided, in combination, for partial-load control. Such a valve solves the problem of obtaining, on the one hand, a reduction in energy consumption in the partial-load range by means of partial-load control and, on the other hand, a limitation of the boost pressure in the full-load range by means of boost control. This valve is advantageously provided in the above-described rotary piston machine according to U.S. Patent Specification 4,714,417 referred to in the introduction. Furthermore, the valve combined in an appropriate way can also be provided for supercharging other engines, particularly motor vehicle engines. The flowing air mass propelled by the machine is fed to the suction side completely or partially, as required, whereby the two valve components are advantageously accommodated in a common housing.

When the engine to be supercharged by means of the rotary piston machine is idling, the valve provided for partial-load control is opened and the engine operates under suction. With increasing load, a preferably continuous closing of the partial-load valve takes place within a predeterminable range, and the engine is supercharged in the required manner by the rotary piston machine. In the full-load range, the valve provided for boost control opens when an adjustable maximum boost pressure is reached. When the load is reduced, these operations take place in reverse order. Because the valve casing is incorporated in the housing, a functionally reliable construction is assured and the space required for installation is increased only negligibly, thereby reducing manufacturing costs. The air circulation valve is arranged in a cover which is sealingly connected to the housing and which advantageously comprises the valve guide and the return line. The proposed valve requires only a small amount of space and weight, which above all is especially important in motor vehicle engines.

BRIEF DESCRIPTION OF THE DRAWINGS

The invention will be described in further detail hereinafter with reference to non-limiting embodiments illustrated in the accompanying drawings in which.

DETAILED DESCRIPTION OF PREFERRED EMBODIMENTS

Figure 1:
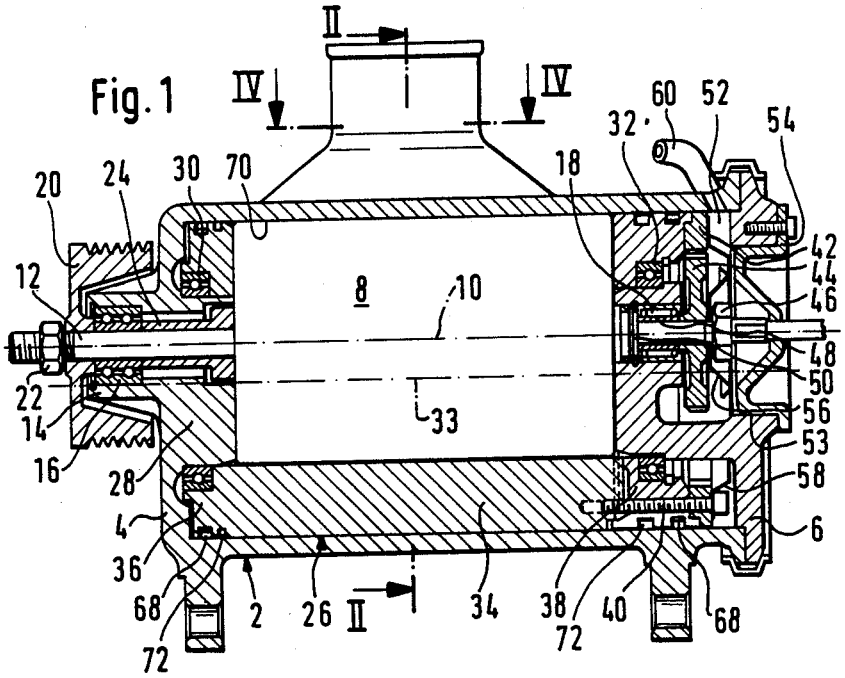
FIG. 1 is an axial section through a rotary piston machine with a pot-shaped housing according to the invention.

FIG. 1 shows, in an axial longitudinal section, the internal axis rotary piston machine with a pot-shaped housing 2 which has a bottom 4 and which is closed off at the other axial end by means of a single housing cover 6. Arranged inside the housing 2 is an inner rotor 8 which is mounted rotatably about an axis 10 by means of a shaft 12 extended out through the bottom 4. For the mounting of the inner rotor 8, a bearing 16, advantageously designed as a combined axial and radial bearing, is arranged in an extension 14 of the bottom 4. A second bearing 18, preferably designed as a needle bearing, is arranged in the housing cover 6 on the other side of the inner rotor 8. The bearing 16 provided in the extension 14 is surrounded by a cup-like belt pulley 20 which lies essentially in the same radial plane as bearing 16 and which is fixedly connected to shaft 12 to rotate therewith. Consequently, when the belt drives the inner rotor 8, it for all practical purposes avoids exertion of a bending moment on the shaft 12 and bearing 16. The inner rotor 8 can be composed of plastic or of light metal and is connected directly to the shaft 12, especially by means of composite casting. This one-piece design assures an appreciable simplification of assembly. The bearing 16 and the belt pulley 20 are secured on the shaft 12 by a nut 22 screwed onto a thread at the shaft end, support against the inner rotor 8 being provided by means of a spacer sleeve 24.

An outer rotor 26 is also arranged inside the housing 2 so that working spaces are formed in a known manner with the inner rotor 8. The fundamental principles and the manner of operation are described in U.S. Pat. No. 4,714,417 which was mentioned in the introduction and is hereby incorporated by reference. The bottom 4 of the housing 2 is provided with a ring 28 which extends axially into the end of the outer rotor 26 and on the outer faces of which the bearing 30 of the outer rotor 26 is arranged. In this embodiment, the outer rotor 26 has three engagement parts 34 which are distributed around the circumference and which are constructed in one piece with a rotor disc 36. Moreover, it is important that the bearing 30 is arranged in the ring 28 in axially spaced relation to the bearing 16 of the inner rotor 8, so that the bearing 30 of the outer rotor 26 has a comparatively small diameter.

At the other axial end, the outer rotor 26 has a ring 38 which is connected to the engagement parts 34 by means of screws 40. According to the invention, the second bearing 32 for the outer rotor 26 is arranged inside the rotor ring 38 on the housing cover 6. An internally toothed wheel 42 is advantageously connected to the outer rotor 26 by means of the same screws 40. The internally toothed wheel 42 meshes with a pinion 44 friction keyed on the shaft 12 of the inner rotor 8. The pinion 44 is compressed by means of a nut 46 against a shaft collar 50 via a bearing sleeve 48. As a result of this particular arrangement, the flank clearance of the gear and the angular relationship between the inner rotor 8 and the outer rotor 26 can be adjusted without difficulty. The gear space 52 is closed off by a closing cover 54 fastened in an opening 53 in the housing cover 6. The gear space 52 is directly accessible for carrying out maintenance or adjustment procedures at any time by removing the closing cover. An important feature here is that, because of the proposed integration and arrangement of the gear and the design of housing cover 6 and closing cover 54, good accessibility and ease of servicing are achieved with a simple construction.

In the gear space 52 there is a splash plate 56 connected to the inner rotor 8 and a splash plate 58 connected to the outer rotor 26, by means of which the supply of lubricant is reliably assured. There is no need for additional fastening means, since the splash plate 56 is secured to the inner rotor 8 by the previously mentioned nut 46, and the splash plate 58 is secured to the outer rotor 26 by the screws 40. A line 60, which opens into the gear space 52 and extends into the suction connection, serves for pressure equalization. This prevents a pressure build up in the gear space 52 in an advantageous manner, which otherwise could result in lubricant being forced into the working spaces. The shaft 12 is extended through the closing cover 54, the gear space 52 being sealed off by means of a shaft seal. Another unit, for example the alternator of a motor vehicle, can be connected to the shaft journal projecting beyond the closing cover 54.

To seal the end faces of the working spaces, the outer rotor 26 has, at each of its two ends, a piston ring 68 resting against the cylindrical inner face 70 of the housing 2. It is essential, furthermore, that, as seen from the working spaces or the inner rotor 8, an annular groove 72 is arranged in the outer face of the outer rotor 26 in front of each of the piston rings 68. Uneven loading of the piston ring 68 is prevented by means of these two annular grooves 72. The narrow annular gap between outer rotor 26 and inner face 70 of the housing, present axially between the working spaces and the annular groove, is also essential in order to prevent an inadmissible pressure loss between the working spaces.

Figure 2:
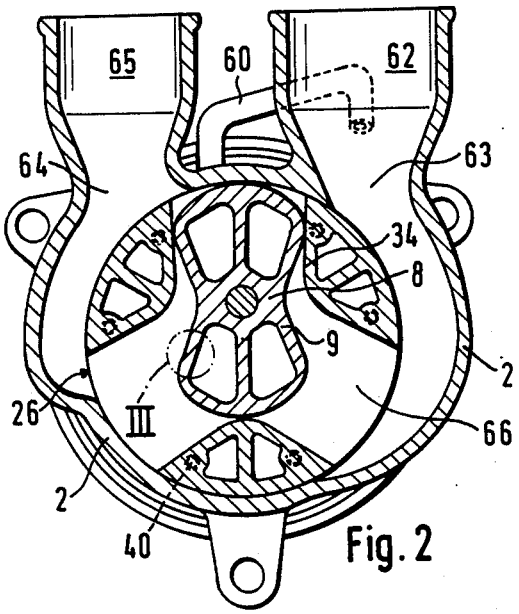
FIG. 2 is a sectional view taken along the section line II—II of FIG. 1.

FIG. 2 shows a radial section along the section line II according to FIG. 1, in which the suction connection 62 with the inlet opening 63 and the pressure connection 65 with the outlet opening 64 can be seen. The aforedescribed line 60 opens into the suction connection 62. Within the scope of this invention, the line 60 which here is shown externally outside the housing 2, can also be incorporated directly in the housing 2 and can, for example, be formed by a bore which is arranged in a correspondingly thickened wall of the housing. The inner rotor 8 is connected directly to the shaft 12. This can be achieved in particular by means of composite casting in which the inner rotor 8 is cast around the previously fabricated shaft 12. This onepiece construction of the inner rotor 8 and shaft 12 results in an appreciable simplification of assembly. The three segments or engagement parts 34 and the three working spaces 66 can be clearly seen here. On the drive side, the rotor parts and engagement parts 34 are connected to the above-described rotor disc to form a single piece. The recesses located between the segments and defining the working spaces are produced by machining a single piece, thus assuring high dimensional accuracy. The engagement parts 9 of the inner rotor 8 and the segments of the outer rotor 26 are advantageously designed as hollow bodies in order to reduce the mass.

Figure 3:
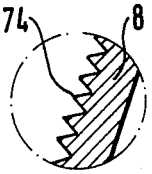
FIG. 3 is an enlarged view of the cut-out III of FIG. 2.

FIG. 3 shows in enlarged fashion the inner rotor 8 which has, on its surface, an axially extending profiling or longitudinal flutes 74. During the initial breaking-in with the outer rotor, the tips of this profiling which project above the surface are worn off or even bent back. Optimum sealing between the inner rotor 8 and the outer rotor, and consequently the working spaces, is ensured.

Figure 4:
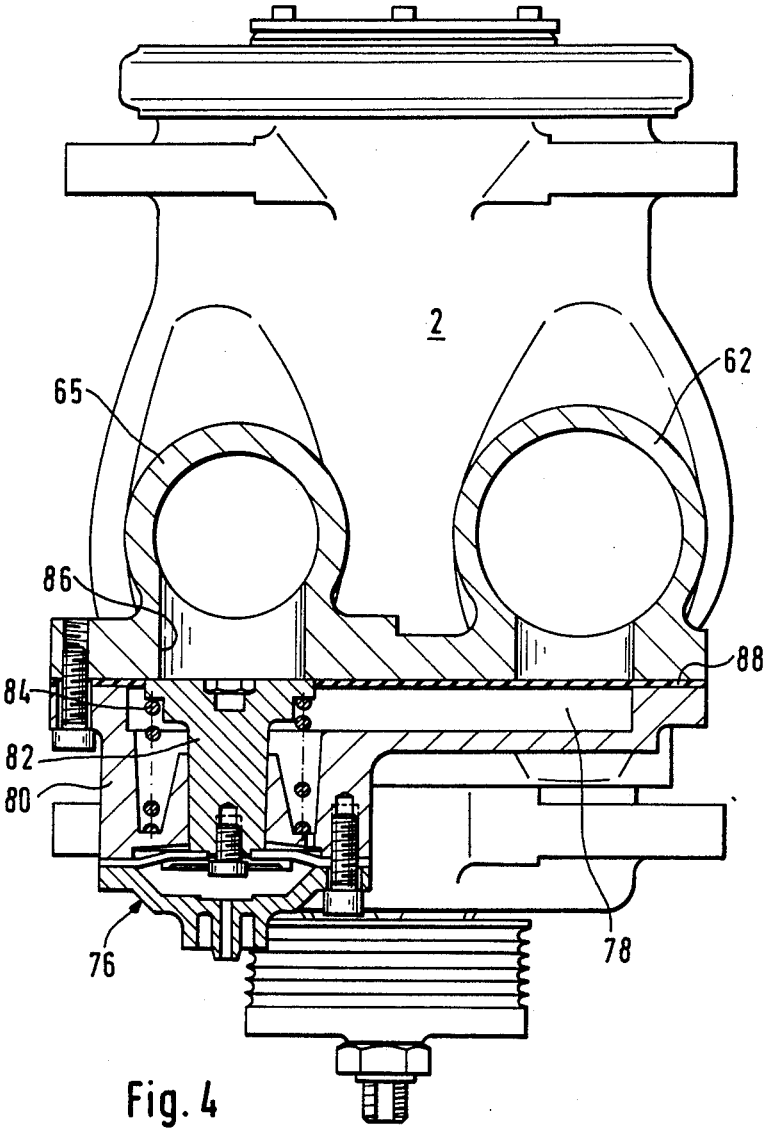
FIG. 4 is a sectional view taken along section line IV—IV of FIG. 1 showing a special embodiment with a valve communicating between the pressure channel and the suction channel.

FIG. 4 shows a section through a rotary piston machine embodiment corresponding to section line IV, in which the suction connection 62 and the pressure connection 65 are cut away and the housing 2 is partially visible in plan view. Within the scope of this invention, a valve 76 and a return line 78 are provided between the pressure connection 65 and the suction connection 62, in order to allow a return flow from the pressure connection to the suction connection in specific operating states. Guided in a valve cover 80 is a valve body 82 which is pressed by a spring 84 onto the valve seat 86 advantageously provided on the housing 2. The valve 76 is advantageously incorporated in this valve cover 80 which is firmly connected through a gasket 88 to the housing 2. The valve cover 80 also contains the return line 78, through which air can flow back into the suction connection 62 when the pressure in the pressure connection 65 is too high.

Figure 5:
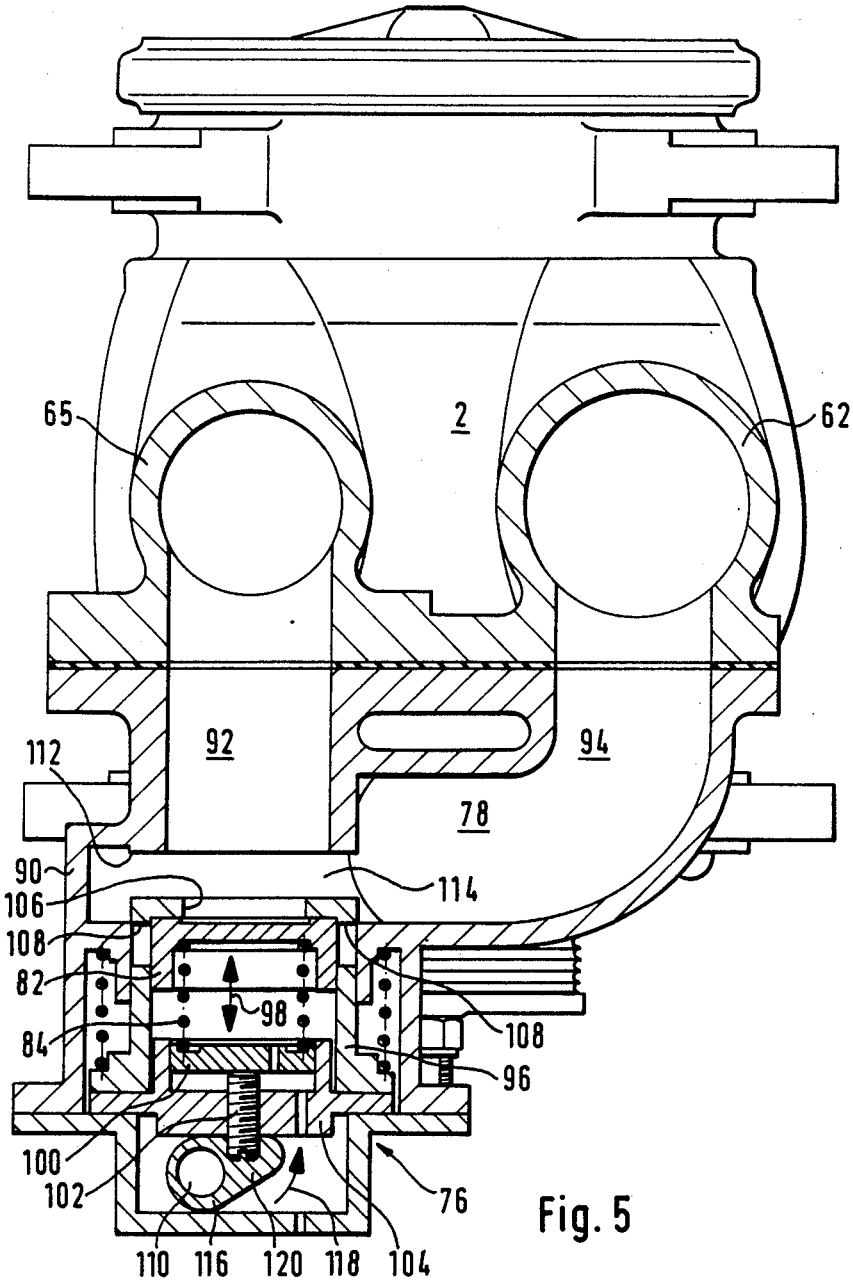
FIG. 5 is a sectional view corresponding to FIG. 4 through a modified embodiment comprising a schematically illustrated valve designed both for partial-load control and boost control.

FIG. 5 shows a section through a special embodiment of the valve 76. This valve is designed not only for limiting the boost pressure in the full-load range, as in the embodiment according to FIG. 4, but also for partial-load control. The valve housing 90 contains a pressure channel 92 and a suction channel 94, between which the return line 78 is arranged. The delivery channel 92 leads to the pressure connection 65 and the suction channel 94 leads to the suction connection 62 of the aforedescribed rotary piston machine housing 2. Within the scope of the invention, the housing 90 can be connected to the housing of the rotary piston machine in a manner corresponding to the attachment of the valve cover explained with reference to FIG. 4. The valve contains a first valve body 82 which is provided for boost pressure control. This first valve body 82 is arranged in a second valve body 96 so as to be displaceable in the direction of the arrow 98. The second valve body 96 serves for partial-load control and is likewise arranged in the housing 90 so as to be displaceable in the direction of arrow 98. The first valve body 82 is supported by means of the spring 84, a plate 100 and a setscrew 102 and a cover 104 which is screwed to the second valve body 96. The biasing force of the spring 84 is varied by means of the setscrew 102, and the maximum boost pressure, at which the valve body 82 can be moved counter to the spring force in the full-load range, is thereby adjusted. The second valve body 96 contains an inlet opening 106 and one or more lateral outlet openings 108. According to the invention, with this type of combined valve, the inlet opening 106 can be shut off relative to the outlet opening 108 in accordance with the illustrated position of the first valve body.

The second valve body 96 is shown in the position which it assumes when the engine to be supercharged is idling. Delivery channel 92 and suction channel 94 are in communication with one another through the partial-load orifice 114, and the engine can operate under suction. According to the invention, the partial-load valve or the valve body 96 can be controlled as a function of the position of the accelerator pedal of the engine. As is to be explained below, the partial-load valve can be actuated mechanically, for example via a pull cable. Furthermore, actuation can also take place pneumatically via the boost pressure, hydraulically or electrically. For mechanical actuation, a shaft 110 is provided which is mounted in a manner not shown further here so as to be rotatable about an axis perpendicular to the plane of the drawing. A pull cable connected directly to the accelerator rod or accelerator pedal for controlling the engine is guided onto this shaft. The partial-load valve 96 is advantageously controlled in such a way that no adjustment of the valve body 96 takes place when the accelerator pedal moves within the range of 0 to $\frac{2}{3}$ of its travel. In this range, the partial-load orifice 114 between the valve seat 112 and the second valve body 96 is open as illustrated, and the engine operates under suction. Upon further actuation of the accelerator pedal and consequently of the pull cable, the shaft 110 and the lever 116, which is fixedly connected to the shaft to rotate therewith, rotate in the direction of the arrow 118. Via the free end 120 of the lever 116 which advantageously rests against the cover 104 via a roller, not shown here, the second valve body 96 is now moved in the direction of the valve seat 112. In the range from two-thirds to three-thirds of the accelerator pedal travel, continuous closing of the partial-load opening 114 desirably takes place. Communication between the delivery channel 92 and the suction channel 94 is closed off by means of the second valve body 96. If, in full-load operation, the boost pressure prevailing in the pressure channel 92 exceeds the maximum boost pressure set through the boost spring 84 by means of the setscrew 102, the first valve body 82 is moved counter to the biasing force of the spring 84. The air can now flow from the pressure channel 92 through the inlet opening 106 to the outlet openings 108 and through the return line 78 into the suction channel 94. The combination according to the invention of partial-load control and boost control with valve 76 assures, on the one hand, a reduction in energy consumption in the partial-load range and an effective limitation of the boost pressure in the full-load range of the engine.

The foregoing description has been set forth merely to illustrate the invention and is not intended to be limiting. Since modifications of the described embodiments incorporating the spirit and substance of the invention may occur to persons skilled in the art, the scope of the invention is to be limited solely with reference to the appended claims and equivalents.

What is claimed is:

1. An internal axis rotary piston machine with meshing engagement between an outer rotor surrounded by a housing and having $n+1$ recesses arranged between engagement parts and an inner rotor with n engagement parts which rotate uniformly at a speed ratio of $(n+1):n$ when there is tooth-flank type contact between inside faces of the outer rotor and outside faces of the inner rotor so that working spaces are formed in the recesses of the outer rotor and move past inlet and outlet orifices of the housing, wherein the housing (2) is constructed in one piece with a pot-shaped form having a bottom (4) on the drive side, wherein said bottom (4) comprises an outer face for a bearing (30) of the outer rotor (26), particularly on a ring (28) extending axially into the end of the outer rotor (26), wherein the outer rotor (26) carries a sealing ring (68) at each of its axial ends, and wherein an annular groove (72) is provided at each axial end of said outer rotor, each said annular groove being positioned axially between the working spaces of said machine and one of the sealing rings (68).

2. A rotary piston machine as claimed in claim 1, wherein said housing (2) carries a suction connection (62); a gear space (52) is provided containing a gear for drivingly connecting the inner rotor (8) and the outer rotor (26), and a pressure equalization line (60) is arranged to communicate between said gear space (52) and said suction connection (62).

3. A rotary piston machine as claimed in claim 1, wherein the inner rotor (8) is directly connected to a shaft (12) on which it rotates.

4. A rotary piston machine as claimed in claim 1, wherein said inner rotor (8) is directly connected to a shaft (12) on which it rotates, and is formed directly on said shaft by composite casting.

5. An internal axis rotary piston machine with meshing engagement between an outer rotor surrounded by a housing and having n+1 recesses arranged between engagement parts and an inner rotor with n engagement parts which rotate uniformly at a speed ratio of (n+1):n when there is tooth-flank type contact between inside faces of the outer rotor and outside faces of the inner rotor so that working spaces are formed in the recesses of the outer rotor and move past inlet and outlet orifices of the housing, wherein the housing (2) is constructed in one piece with a pot-shaped form having a bottom (4) on a drive side; said bottom (4) comprises an outer face for a bearing (30) of the outer rotor (26); a gear space (52) is provided containing a gear for drivingly connecting the inner rotor (8) and the outer rotor (26), said inner rotor (8) having a shaft (12) which is directed outwardly on said drive side of said machine; said gear space (52) is arranged at the other side of said machine in a housing cover (6) provided with an opening (53) through which said gear space is accessible, and said opening is closed by a removable closing cover (54).

6. An internal axis rotary piston machine with meshing engagement between an outer rotor surrounded by a housing and having n+1 recesses arranged between engagement parts and an inner rotor with n engagement parts which rotate uniformly at a speed ratio of (n+1):n when there is tooth-flank type contact between inside faces of the outer rotor and outside faces of the inner rotor so that working spaces are formed in the recesses of the outer rotor and move past inlet and outlet orifices of the housing, wherein the housing (2) is constructed in one piece with a pot-shaped form having a bottom (4) on the drive side; said bottom (4) comprises an outer face for a bearing (30) of the outer rotor (26); said housing carries a suction connection (62) communicating with the inlet orifice of said housing and a pressure connection (65) communicating with the outlet orifice of said housing; a valve (76) is interposed between said suction connection (62) and said pressure connection (65) through which communication between the pressure connection (65) and the suction connection (62) can be established and disestablished in response to opening and closing of said valve, and said valve (76) comprises a first valve body (82) for boost control and a second valve body (96) for partial-load control, said first valve body (82) being displaceably arranged within said second valve body (96) to normally close off an inlet opening (106) of said second valve body with respect to an outlet opening (108) of said second valve body, and to open said inlet opening (106) to said outlet opening (108) when a desired maximum pressure is exceeded in said pressure connection.

7. A rotary piston machine as claimed in claim 6, wherein said first valve body (82) is supported within said second valve body (96) via a spring (84) and a plate (100) which is arranged so as to be displaceable by means of a setscrew (102) in order to adjust the spring tension of said spring.

8. A rotary piston machine as claimed in claim 7, wherein said first valve body (82) is supported in a cover (104) connected firmly to said second valve body (96).

9. A rotary piston machine as claimed in claim 6, wherein said second valve body (96) is movable when said machine is subjected to a partial machine load within a predetermined partial-load range in order to continuously close off and open a partial-load control opening (114) communicating between a pressure channel (92) and a suction channel (94) of said machine.

10. A rotary piston machine as claimed in claim 9, wherein said second valve body is movable in response to movement of an accelerator pedal of a motor vehicle engine within a range of pedal travel from two-thirds of its travel to three-thirds (full) travel.

* * * * *